US006368035B1

(12) United States Patent
Recupido et al.

(10) Patent No.: US 6,368,035 B1
(45) Date of Patent: Apr. 9, 2002

(54) MECHANISM TO FACILITATE RAISING AND LOWERING HINGED END SECTION OF DECK

(75) Inventors: Robert J. Recupido, Frankfort, IL (US); Robert J. Cencer, Tecumseh, MI (US); Richard B. Shaddle, Sandwich, IL (US)

(73) Assignee: TRN Business Trust, Dallas, TX (US)

( * ) Notice: Subject to any disclaimer, the term of this patent is extended or adjusted under 35 U.S.C. 154(b) by 0 days.

(21) Appl. No.: 09/631,320

(22) Filed: Aug. 3, 2000

Related U.S. Application Data

(60) Provisional application No. 60/147,649, filed on Aug. 6, 1999.

(51) Int. Cl.[7] ..... B60P 7/00

(52) U.S. Cl. ..... 410/26; 410/24; 410/27; 410/29

(58) Field of Search ..... 410/24, 26, 29, 410/27; 105/370, 372, 375

(56) References Cited

U.S. PATENT DOCUMENTS

| | | | | |
|---|---|---|---|---|
| 3,927,621 A | | 12/1975 | Skeltis et al. | |
| 3,977,123 A | | 8/1976 | Clay, Jr. et al. | |
| 4,119,042 A | | 10/1978 | Naves et al. | 410/27 |
| 4,119,043 A | * | 10/1978 | Naves et al. | 410/27 |
| 4,149,472 A | * | 4/1979 | Naves et al. | 410/26 |
| 4,238,168 A | * | 12/1980 | Naves | 410/27 |
| 4,248,557 A | * | 2/1981 | Roldnesset al. | 410/27 |
| 4,252,482 A | * | 2/1981 | Naves | 410/27 |
| 4,318,649 A | * | 3/1982 | Roldness et al. | 410/27 |
| 4,759,669 A | * | 7/1988 | Robertson et al. | 410/29 |
| 4,786,222 A | * | 11/1988 | Blodsett | 410/29 |
| 5,685,228 A | | 11/1997 | Ehrlich et al. | |
| 5,794,537 A | | 8/1998 | Zaerr et al. | |

OTHER PUBLICATIONS

Excerpts from the Portec Service Order Catalog (4 pages); No Date.

Copies of photographs showing a counterweight arrangement built by the Paragon Bridge & Steel Co. 3 pages, No Date.

* cited by examiner

*Primary Examiner*—Stephen T. Gordon
(74) *Attorney, Agent, or Firm*—Fitch, Even, Tabin & Flannery

(57) ABSTRACT

A mechanism to assist in raising and lowering a hinged deck end section wherein a lifting force is applied to the deck end section by a counterweight mechanism. In the preferred embodiment, the counterweight mechanism operates in conjunction with a conventional, proven spring assist mechanism of the type that has been used in the past on trilevel railway cars. The counterweight mechanism preferably includes a counterweight that is slidable along a vertical track in a location that is readily accessible for visual inspection and maintenance. Nonmetallic wear pads are preferably employed in conjunction with a dry film lubricant to control friction between the counterweight and the track. The mechanism preferably provides a mechanical advantage so that the lifting force applied by the counterweight mechanism exceeds the weight of the counterweight. A roller chain, steel cable, or the like is preferably employed to connect the weight to the deck end section.

9 Claims, 8 Drawing Sheets

20
60
62
44
34
32
70
48
46
30
38
78
24
70
22

44
36
76
32
74
38
24
70
70
80
78
30
48
74
42
46
20

Fig. 7
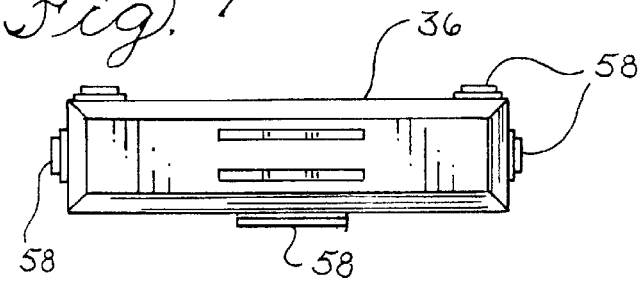
Fig. 9
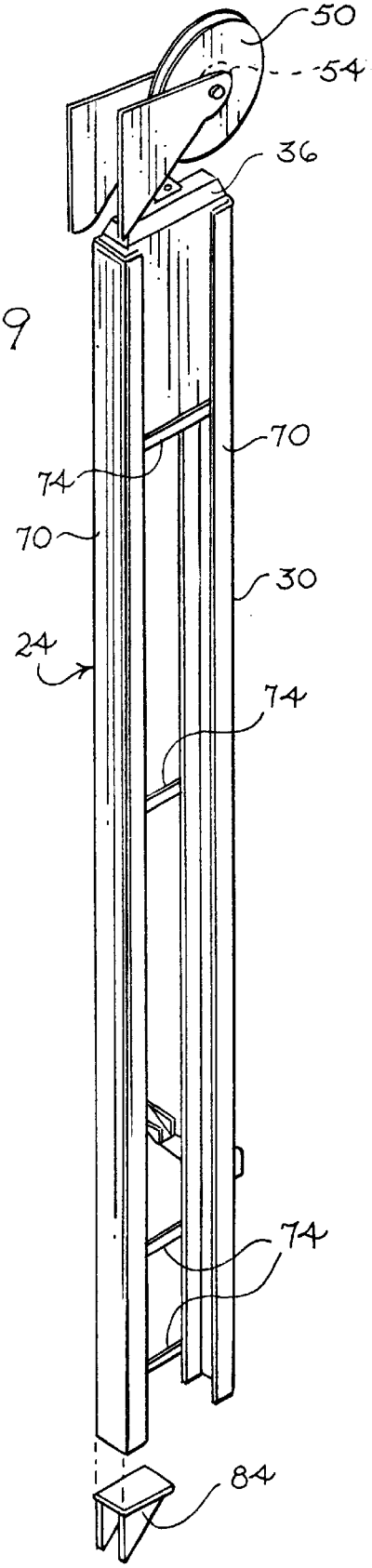
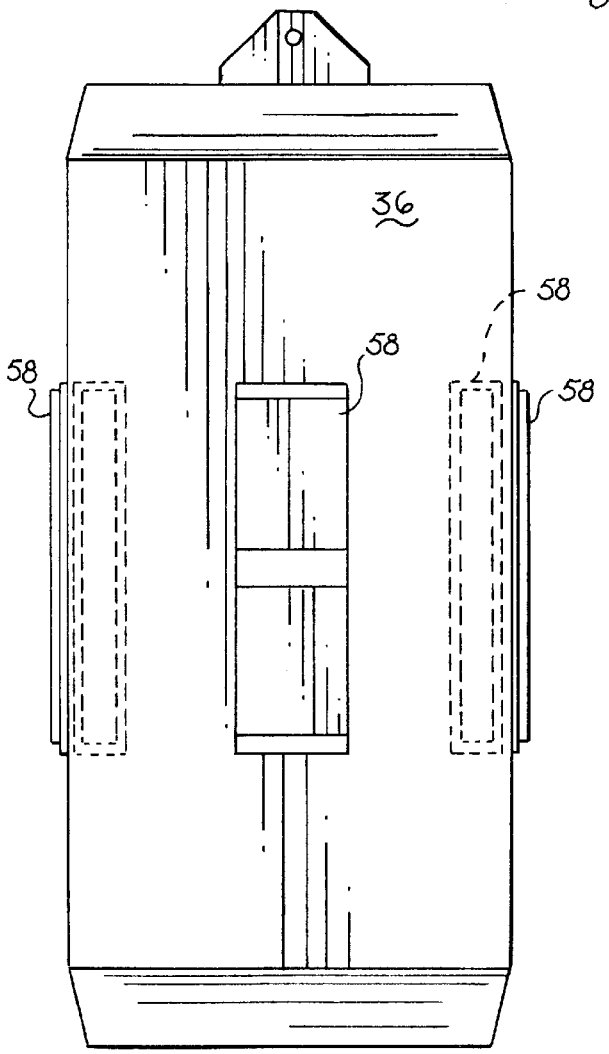
Fig. 6

Fig. 12
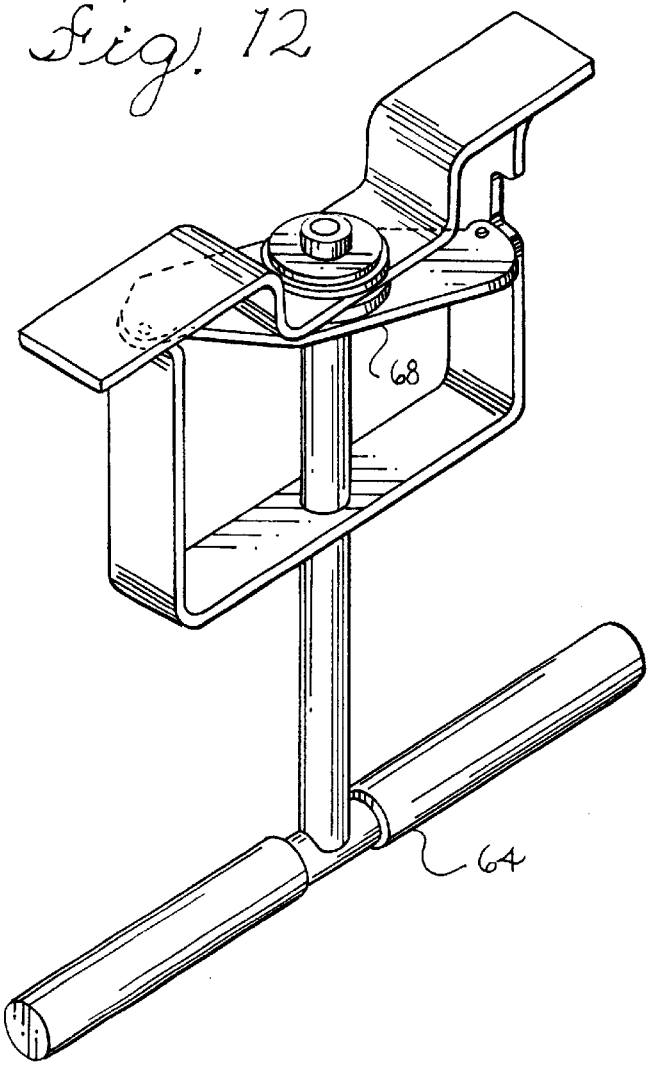
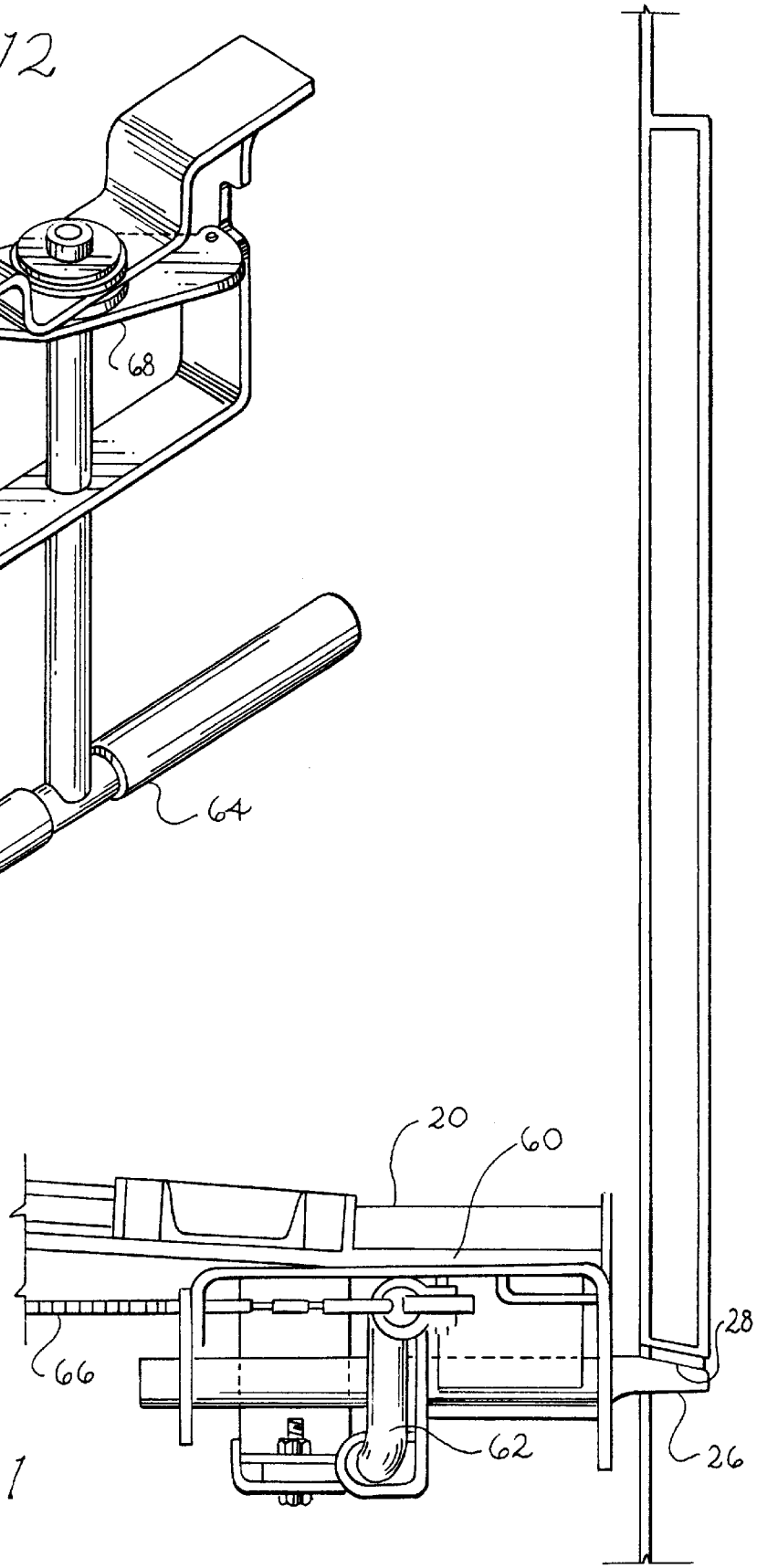
Fig. 11

MECHANISM TO FACILITATE RAISING AND LOWERING HINGED END SECTION OF DECK

This application claims priority on U.S. Provisional Patent Application No. 60/147,649, filed Aug. 6, 1999, entitled "Mechanism to Facilitate Raising and Lowering Hinged End Section of Deck," the disclosure of which is incorporated herein by reference.

BACKGROUND OF THE INVENTION

The invention relates generally to railcars, and more particularly to railcars for transportation of automotive vehicles.

For many years, autorack cars have been used for rail transport of automotive vehicles. A tri-level autorack car typically includes hinged end sections on the middle ("B") deck to enable the each end of the deck to pivot between a lower position for supporting automotive vehicles and an upper position for increasing clearance to permit loading and unloading of vehicles on the bottom ("A") deck.

The hinged end section is held in position by pins at opposite sides, and is manually lifted and lowered. To raise or lower the deck, a worker first releases a pin on one side, then releases a pin on the other side, then raises or lowers the deck to its new position. For many years, spring assist mechanisms have been employed to provide upward forces on the end sections to reduce the weight that must be handled by a worker raising or lowering the deck end. These mechanisms typically include a pair of coil springs loaded in tension, one on each side of the deck. The spring mechanisms provide sufficient lift that when the deck end is in its lower position, it is biased upward. However, in its upper position, the lift is decreased, and the deck end will tend to drop toward a middle, neutral position when released from its upper position. Similarly, the spring force above is sufficient to lift the deck to a neutral position when it is released from its lower position. When a pin is unlocked on one side of the deck, that side moves a sufficient distance toward a neutral position to enable the pin to be released without the pin returning to the locked position.

Within the last few years, trilevel railcars have been developed that have bottom ("A") decks more deeply recessed than those of the earlier trilevel cars discussed above. As a result, longer, heavier hinged end sections having greater vertical travel have been provided on their "B" decks to provide clearance.

While the prior art spring assist mechanisms described above have been commercially successful and have proven satisfactory in operation, it would be difficult or impossible for a worker to handle the longer, heavier hinged end sections without more lift than that provided by the prior art spring assist mechanisms.

In providing a satisfactory mechanism to assist in raising and lowering the larger hinged deck portions, a number of considerations must be addressed. Due to the requirements for ventilation of railcars carrying automotive vehicles, the railcar interior is, to some extent, exposed to temperature extremes and other harsh weather conditions and to ingress of airborne particulate matter. The mechanism must be capable of operating satisfactorily while withstanding such exposure for periods of several years of commercial use. In addition, the mechanism must be capable of withstanding continuously varying dynamic loads associated with the travel of the railcar while the railcar is in motion. Furthermore, the mechanism should be relatively simple to operate due to the fact that, over the course of its service life, the mechanism is likely to be operated by many different workers having varying degrees of skill and training. On a related point, the mechanism should be capable of withstanding misuse without jamming or otherwise failing. Also, the mechanism must not unduly increase the cost or weight of the railcar, and must not unduly restrict interior clearances.

One possible alternative to the prior art mechanisms is to employ one or more hand-cranked winch mechanisms. See, e.g., U.S. Pat. No. 5,743,192 to Saxton et al. However, it is believed that the time required for hand cranking of such winch mechanisms is a significant disadvantage.

Another possible alternative is to rely upon hand-held power tools to interface with winch mechanisms. However, this approach would have significant disadvantages in requiring specialized power tools and power sources for the tools to be available on the railcar or at loading and unloading locations, with the consequence of unavailability or mechanical failure of the tools or power sources at a particular site being potentially costly delays in loading and unloading operations. To avoid this problem, it is desirable that a mechanism for assisting in raising and lowering hinged deck end sections be operable without requiring any equipment other than that provided on the railcar, and without requiring an external power source.

It is a general object of the invention to provide an improved system to assist a single worker to efficiently and safely raise or lower a hinged deck portion of a trilevel railcar.

SUMMARY OF THE INVENTION

The invention provides a novel mechanism to assist in raising and lowering a large, heavy hinged deck end section such that a single worker can raise or lower the deck end section quickly and efficiently. Lifting force is applied to the deck end section by a counterweight mechanism. In the preferred embodiment, the counterweight mechanism operates in conjunction with a conventional, proven spring assist mechanism of the type that has been used in the past on trilevel railway cars. The counterweight mechanism preferably includes a counterweight that is slidable along a vertical track in a location that is readily accessible for visual inspection and maintenance. Nonmetallic wear pads are preferably employed in conjunction with a dry film lubricant to control friction between the counterweight and the track. The mechanism preferably provides a mechanical advantage so that the lifting force applied by the counterweight mechanism exceeds the weight of the counterweight. A roller chain, steel cable, or the like is preferably employed to connect the weight to the deck end section.

BRIEF DESCRIPTION OF DRAWINGS

FIG. 6 is an enlarged rear elevational view of a counterweight.

FIG. 7 is a plan view thereof.

FIG. 9 is an oblique view of the mechanism of FIG. 4.

FIG. 11 is an enlarged detail view of a portion of FIG. 10.

FIG. 12 is an enlarged oblique view of the deck release mechanism shown in FIG. 10.

DETAILED DESCRIPTION OF PREFERRED EMBODIMENTS

Figure 1:
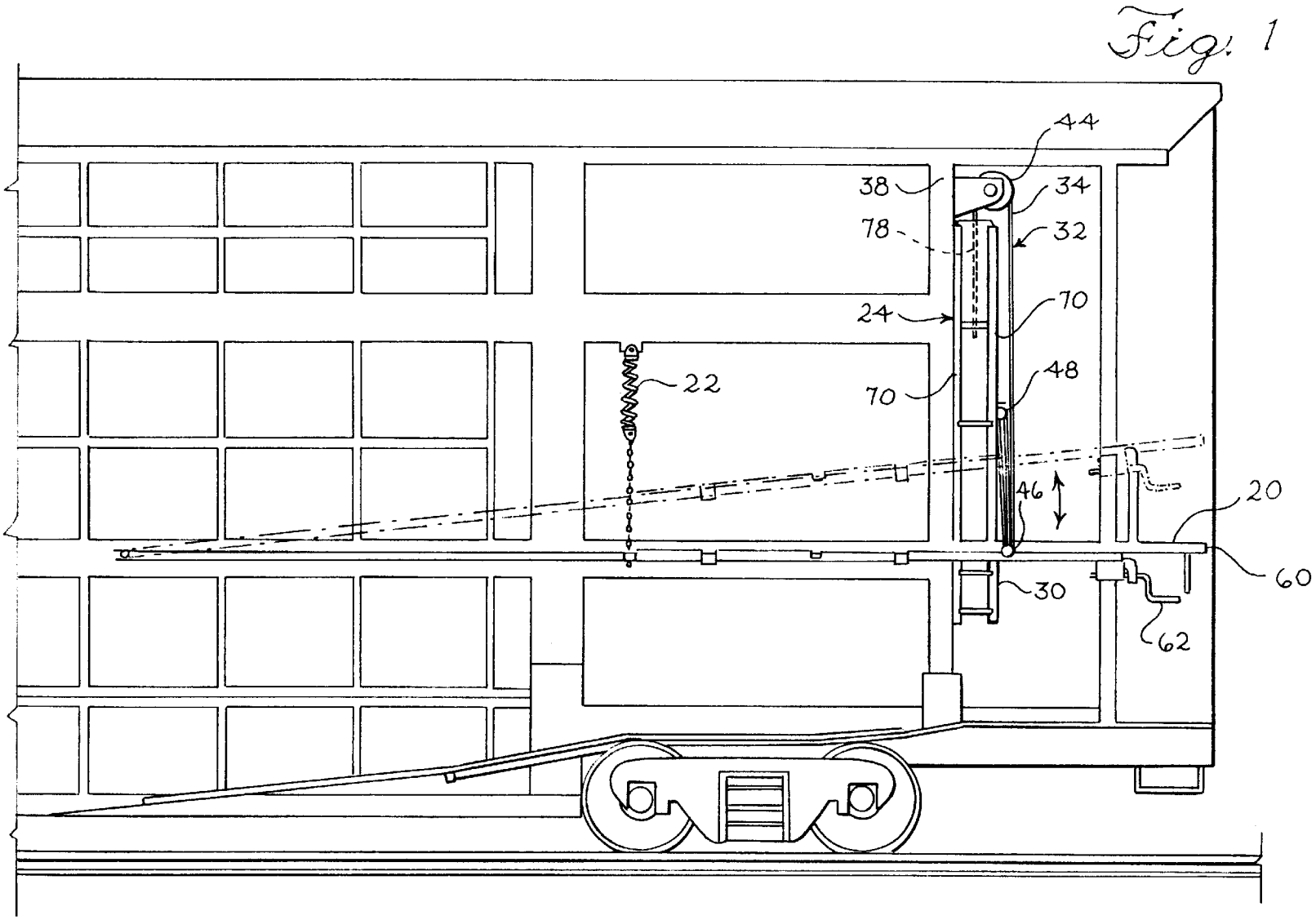
FIG. 1 is a schematic side elevational view of a railcar including a mechanism to facilitate raising and lowering a hinged deck section in accordance with a first embodiment of the invention.
Figure 2:
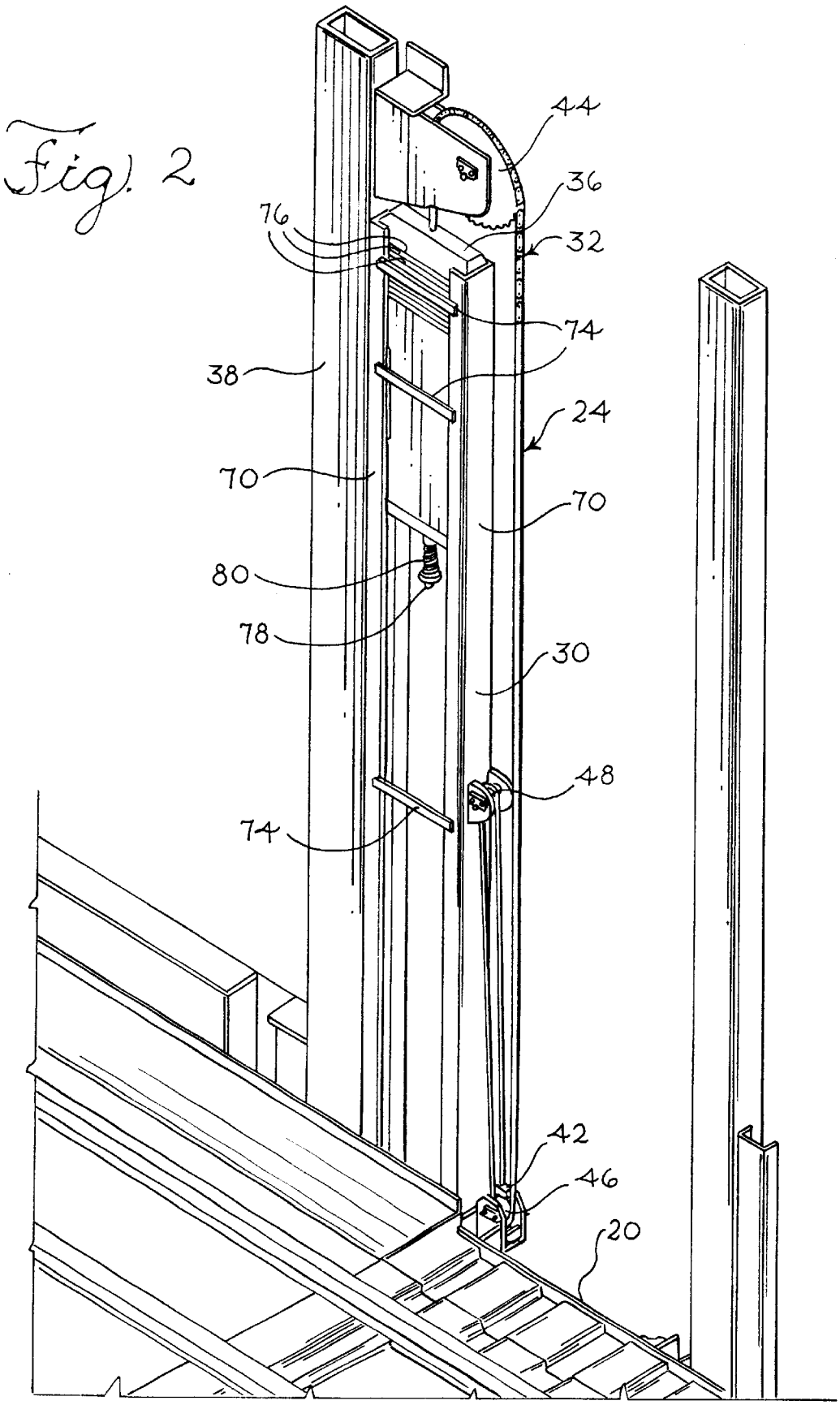
FIG. 2 is a more detailed view of the mechanism.
Figure 3:
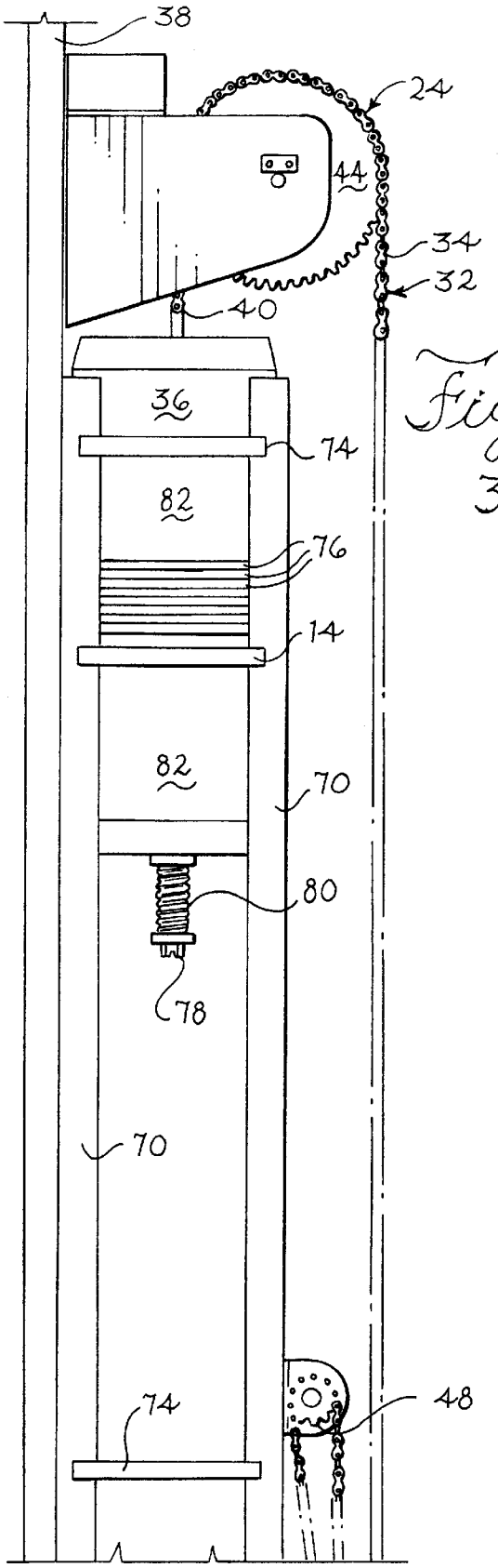
FIG. 3 is an enlarged side elevation of an upper portion of the mechanism.
Figure 4:
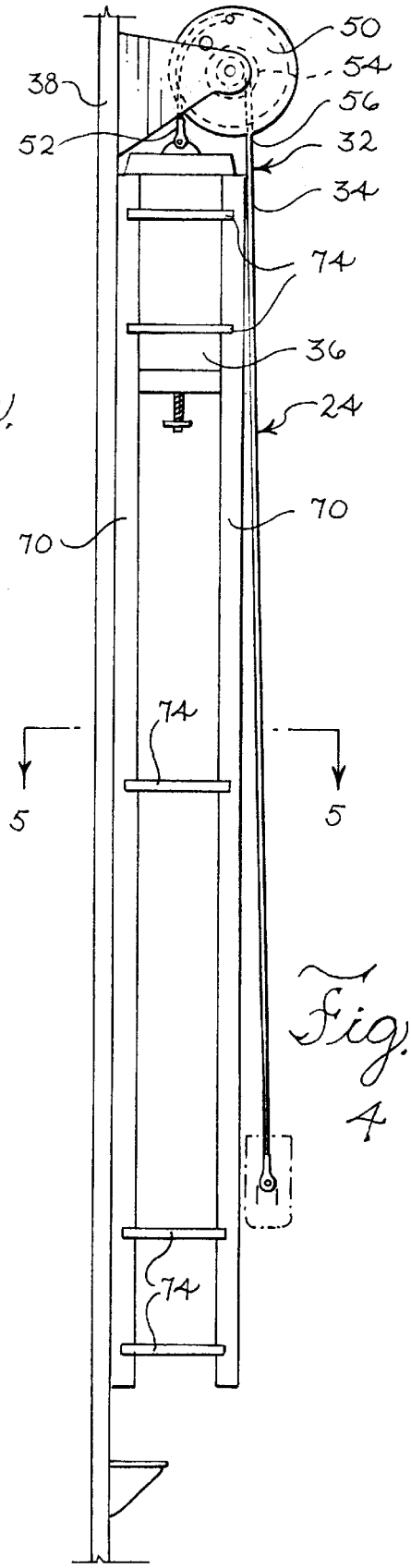
FIG. 4 is a side elevation of a mechanism in accordance with a second embodiment of the invention.

The invention is preferably embodied in a mechanical system to facilitate pivoting of a movable end portion 20 of a railcar deck between upper and lower positions. A first embodiment of the invention is illustrated in FIGS. 1—3. In FIG. 1, the movable portion is shown in its upper position in broken lines, and in its lower position in solid lines. The system preferably includes spring assist mechanisms 22 in conjunction with counterweight mechanisms 24 on each side of the deck.

Figure 10:
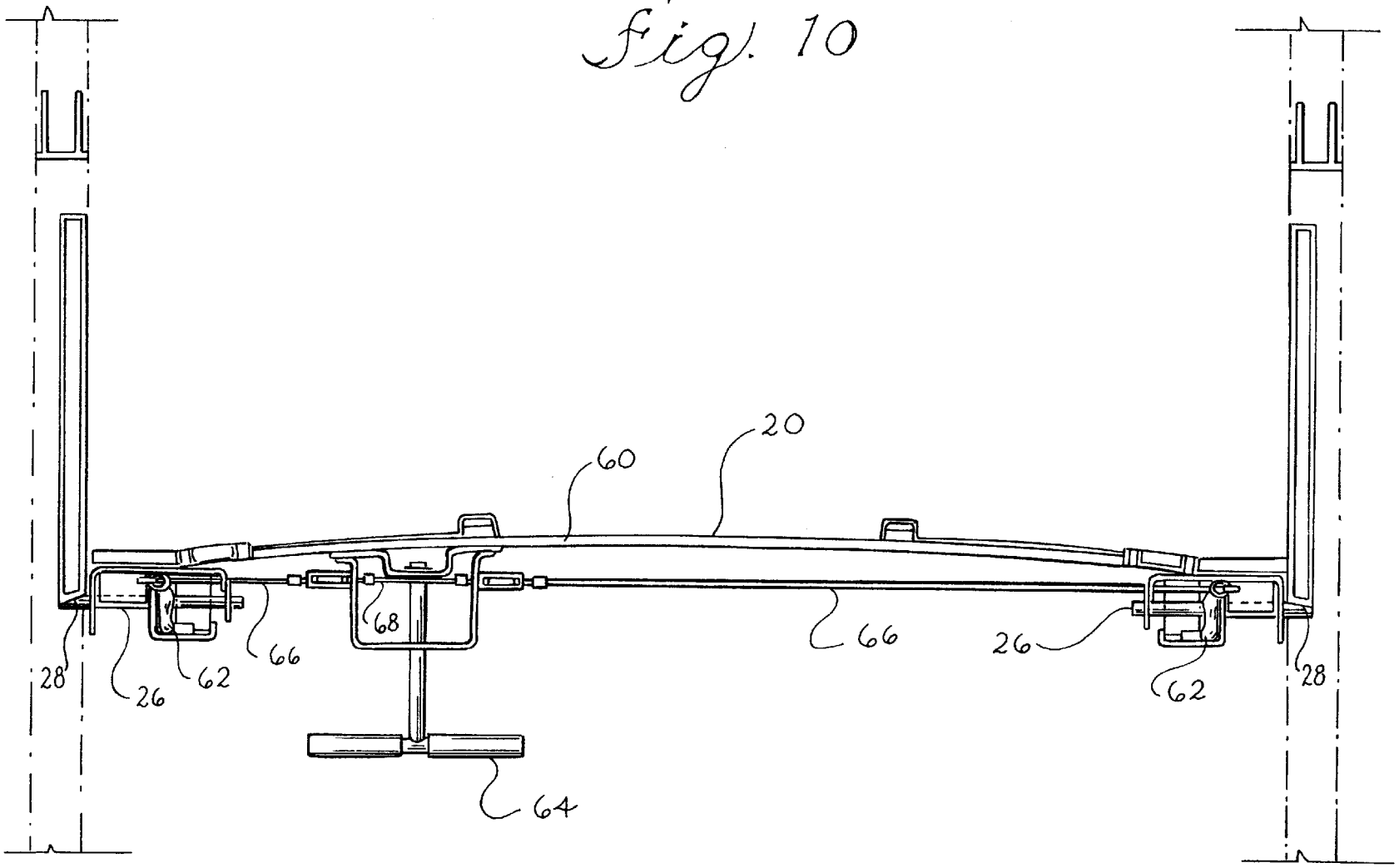
FIG. 10 is an end elevation of the hinged deck section.

As shown in FIGS. 10–12, the deck end is preferably equipped with a locking mechanism comprising a pair of spring-loaded pins 26 movable between locked positions securing the deck end section in its upper or lower position, and unlocked positions permitting the deck end section to be lifted or lowered. Each of the pins 26 is equipped with means to enable a worker to pull the pin from locked to unlocked position.

Each of the spring assist mechanisms 22 preferably comprises a coil spring loaded in tension. The spring mechanisms may be similar or identical to those that have been used on trilevel railcars in the past, and may be positioned so that their changes in length during raising and lowering of the deck are similar or identical to those of the prior mechanisms.

The spring mechanisms 22 provide a variable lifting force that is maximized when the movable deck portion is in its lower position. In conjunction with the counterweights, they preferably provide sufficient lift to bias the movable deck portion upward when in its lower position. If the upward force is too great, it will be difficult for a worker to lower the deck into its lower position, and it will also be difficult to release the locking pins 26 when the deck is in its lower position, due to friction between the pins and the surfaces 28 against which they lock.

In the preferred embodiment of the invention, the counterweight mechanisms 24 provide substantially uniform lift, independent of the position of the deck end portion, over its full range of motion. This facilitates providing sufficient lift near the top of the range of motion of the movable deck portion while assuring that the lift near the bottom of the range of motion is not so great as to make it unduly difficult for a single worker to pull the deck portion into its lower position, or to pull the pins to release the deck from its lower position. The movable deck portion can be raised or lowered simply by pushing or pulling it after releasing the locking pins.

The counterweight mechanism 24 preferably is disposed in an accessible location to facilitate inspection and maintenance In the illustrated embodiment, the counterweight mechanism 24 includes a counterweight that travels within a recessed track 30. In the embodiment of FIGS. 1–3, the counterweight comprises a pair of large weights 82 with a stack of plates 76 therebetween, all having aligned central openings therein to receive a vertical support 78. A coil spring 80 loaded in compression may be provided at the bottom of the stack to cushion the impact of the weight as it stops at the bottom of its stroke.

The movable deck section 20 may be heavier on one side than the other due to, e.g., a chock track extending along one side. To accommodate this, the counterweights on opposite sides may be of different weights. The weight of a particular counterweight may be adjusted by adding or removing plates. The track 30 constrains the counterweight 36 against horizontal movement, but does not reduce the minimum horizontal clearance for automotive vehicles in the railcar interior. To this end, the track 30 is disposed in a recess adjacent a structural post 38, and is dimensioned so that it does not project inward substantially beyond the post. The illustrated track comprises a pair of C-shaped channels 70 joined by a shear plate 72 (FIG. 5) and braces 74. The shear plate 72 is part of the side wall of the railcar. A removable cover may be provide to enclose part or all of the track. The cover may be made of plexiglass or other transparent material to permit visual inspection of the counterweight mechanism.

The counterweight mechanism includes a connecting mechanism 32 comprising at least one elongated flexible member 34 connecting the counterweight to the hinged end portion 20 of the deck, and preferably provides a mechanical advantage so that the counterweight mechanism applies an upward force to the hinged end portion in excess of the weight of the counterweight. This enables the counterweight mechanism to provide sufficient lift without adding excessive weight to the railcar. In addition, leverage is provided by attaching the counterweight mechanism to the movable deck section 20 between the spring mechanisms and the free end 60 of the deck section 20. Thus, the preferred embodiment takes advantage of the height of the railcar by providing a long stroke for the counterweight, extending from below the B deck to a location near the top of the side wall of the car, above the C deck.

Each counterweights preferably has a weight of between 200 and 400 lbs., and in the preferred embodiment has a weight of 200–300 lbs. In the preferred embodiment, the connecting mechanisms 32 provides a 3:1 mechanical advantage so that the counterweight 36 applies an upward force of 600–900 lbs. to the movable deck end section, with the pair of counterweights providing a total upward force of 1,200–1,800 lbs.

In the embodiment of FIGS. 1–3, the connecting mechanism 32 comprises a roller chain that has a first end 40 affixed to the vertical support 78 extending through the counterweight, and a second end 42 affixed to the movable deck portion. The roller chain extends upward from the counterweight and over the top of an upper sprocket 44 rotatably mounted on a fixed support mounted on the railcar sidewall, then downward around the bottom of a lower sprocket 46 rotatably mounted on the movable deck portion, then upward and over the top of an intermediate sprocket 48 mounted on the sidewall, then downward to the movable deck portion 20.

The vertical support 78 may comprise an elongated bolt or rod having an enlarged head at its lower end. The coil spring 80 may act against the head or against a washer supported by the head. The upper end of the vertical support 78 is connected to the chain.

In the embodiment illustrated in FIGS. 4–9, the connecting mechanism comprises a first reel 50 having a first cable 52 wrapped thereon supporting a counterweight 36 disposed in a recessed track 30, and a second reel 54 having a second cable 56 wrapped thereon connected to the hinged end portion 20. The reels 50 and 54 are affixed to a common shaft. To provide a mechanical advantage so that the counterweight mechanism applies an upward force to the hinged end portion in excess of the weight of the counterweight, the first reel has a diameter greater than that of the second reel.

Figure 5:
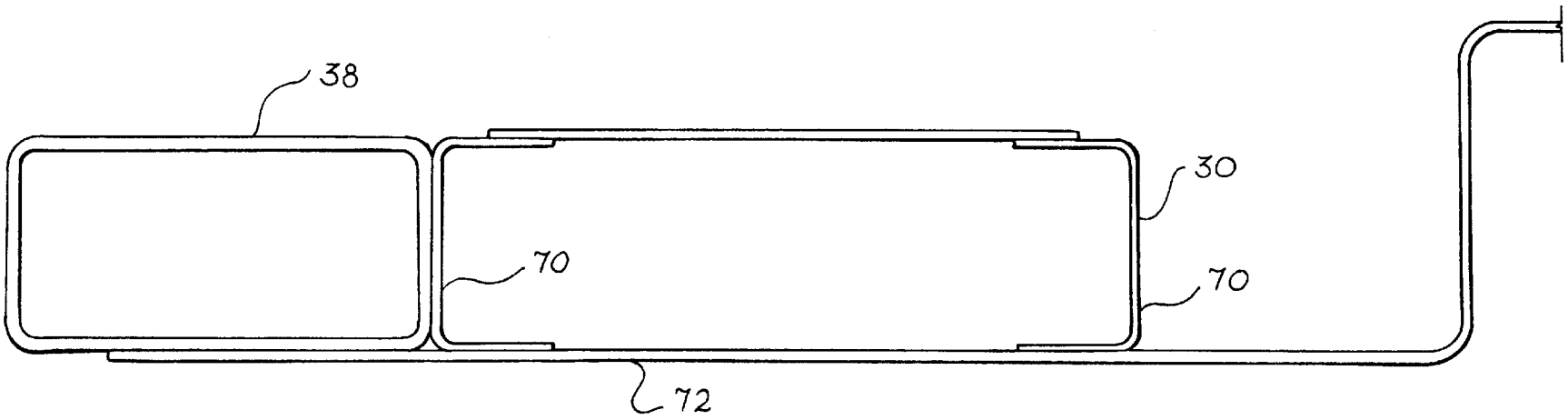
FIG. 5 is a sectional view taken substantially along line 5—5 in FIG. 4.
Figure 8:
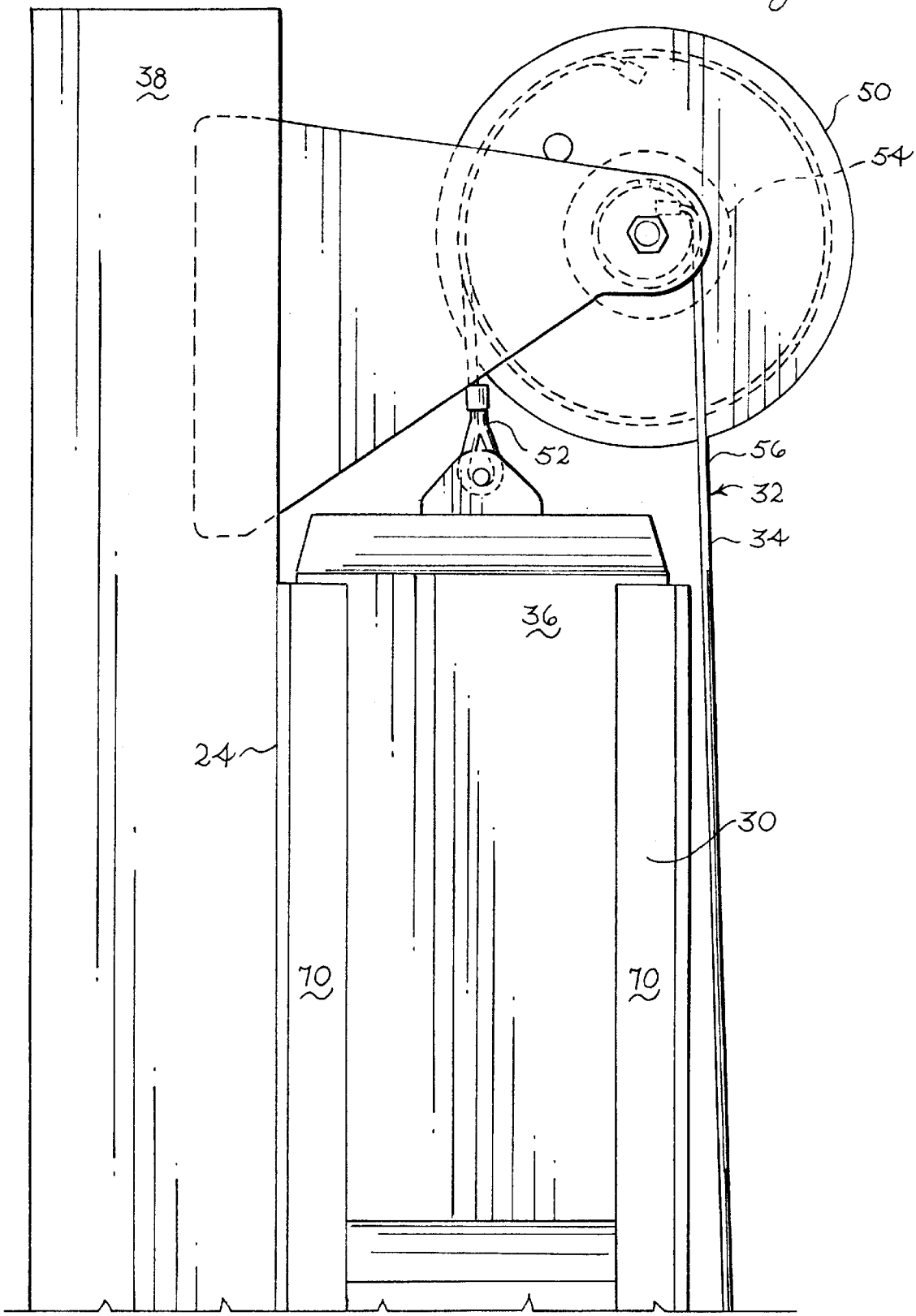
FIG. 8 is an enlarged side elevation of an upper portion of the mechanism of FIG. 4.

In both embodiments, to provide a low friction, non-binding, reliable sliding engagement between the counterweight 36 and its track 30, non-metallic wear pads or wear strips 58 are preferably applied on either the track or the counterweight. In the illustrated embodiments, non-metallic low friction wear pads 58 made of a polymer such as HDPE or PTFE, or another suitable material, are provided on the ends and on one side of the counterweight adjacent its corners to engage the track, and on the rear face of the counterweight to engage the shear plate 72 (FIGS. 5). A conventional dry film lubricant may be employed to reduce friction between the wear pads 58 and the track 30.

In both embodiments, to prevent the weight from falling out the bottom of the track 30 in the event of a failure of the elongated flexible member 34, a safety stop 84 (FIG. 9) is preferably provided beneath the track. In one embodiment, the free end 60 of the hinged end portion travels about 33 in. between its lower position and its upper position. As shown in the drawings, the deck is equipped with locking pins or rods to lock the deck in upper or lower position. The locking pins are biased outward toward their locked positions.

In the arrangement illustrated in FIGS. 10–12, an unlocking mechanism is provided to permit simultaneous unlocking of locking pins on both sides of the deck. The unlocking mechanism comprises a rotatable T-shaped handle 64 mounted on the underside of the hinged end portion 20 of the B deck at its free end 60, connected to the pins 26 by elongated connecting members 66 such as cables, chains, or the like. The T-shaped handle 64 has an attachment plate 68 thereon configured to exert tension on the connecting members 66 to pull the pins 26 to their unlocked positions when the handle is rotated. With this unlocking mechanism, a worker can simply twist the handle 64 to unlock the deck, then lift or lower the handle to move the deck to its desired position in a single, continuous operation.

In other embodiments, rather than including a simultaneous unlocking mechanism, the pins may be provided with individual lever handles 62 (FIG. 1) similar or identical to those of prior art decks, and/or with mechanisms of the type disclosed in U.S. patent application Ser. No. 09/577,752, "Railway Car Deck Locking Mechanism", assigned to Thrall Car Manufacturing Company and filed May 23, 2000, the disclosure of which is incorporated herein by reference.

From the foregoing, it will be appreciated that the invention provides an improved mechanism to assist in adjustment of a movable railcar deck end section. The invention is not limited to the embodiments described above. Additional features of the invention are shown in the accompanying drawings. The invention is further described and particularly pointed out in the following claims.

What is claimed is:

1. In a railway car for carrying automotive vehicles having a deck with a hinged end portion movable between a lower position and an upper position, the improvement comprising a counterweight mechanism connected to said hinged end portion to balance at least a portion of the weight of said hinged end portion to facilitate pivoting of said hinged end portion between said lower position and said upper position, said counterweight mechanism being disposed in an accessible location to facilitate inspection and maintenance.

2. In a railway car for carrying automotive vehicles having a deck with a hinged end portion movable between a lower position and an upper position, the improvement comprising a counterweight mechanism connected to said hinged end portion to balance a portion of the weight of said hinged end portion to facilitate pivoting of said hinged end portion between said lower position and said upper position, said counterweight mechanism being disposed in an accessible location to facilitate inspection and maintenance;

said counterweight mechanism comprising a counterweight disposed within a recessed track so that said counterweight does not reduce the minimum horizontal clearance for automotive vehicles, and a connecting mechanism comprising a roller chain and a plurality of sprockets associated therewith to provide a mechanical advantage so that said counterweight mechanism applies an upward force to said hinged end portion in excess of the weight of said counterweight;

said improvement further comprising a spring assist mechanism operating in conjunction with said counterweight mechanism to apply lift to said hinged end portion;

said counterweight mechanism further comprising nonmetallic wear pads disposed on said counterweight to slide along said track between said counterweight and said track, and a dry film lubricant to reduce friction between said nonmetallic wear pads and said track.

3. In a railway car for carrying automotive vehicles having a deck with a hinged end portion movable between a lower position and an upper position, the improvement comprising a counterweight mechanism comprising a counterweight disposed within a recessed track so that it does not reduce the minimum horizontal clearance for automotive vehicles on said deck, said counterweight mechanism connected to said hinged end portion to balance at least a portion of the weight of said hinged end portion to facilitate pivoting of said hinged end portion between said lower position and said upper position, said counterweight mechanism being disposed in an accessible location to facilitate inspection and maintenance.

4. The improvement of claim 3 wherein said counterweight mechanism further comprises a connecting mechanism that connects said counterweight to said hinged end portion and provides a mechanical advantage so that said counterweight mechanism applies an upward force to said hinged end portion in excess of the weight of said counterweight.

5. The improvement of claim 4 wherein said connecting mechanism comprises a roller chain in conjunction with a plurality of sprockets.

6. The improvement of claim 4 wherein said connecting mechanism comprises a first reel having a first diameter and a cable wrapped on said first reel supporting said counterweight, and a second reel having a second diameter and a cable wrapped on said second reel connected to said hinged end portion; said first diameter being greater than said second diameter.

7. In a railway car for carrying automotive vehicles having a deck with a hinged end portion movable between a lower position and an upper position, the improvement comprising a counterweight mechanism connected to said hinged end portion to balance at least a portion of the weight of said hinged end portion to facilitate pivoting of said hinged end portion between said lower position and said upper position, said counterweight mechanism being disposed in an accessible location to facilitate inspection and maintenance, and a spring assist mechanism operating in conjunction with said counterweight mechanism to apply lift to said hinged end portion.

8. The improvement of claim 3 further comprising nonmetallic wear pads disposed on said counterweight to slide along said track between said counterweight and said track.

9. The improvement of claim 8 further comprising a dry film lubricant to reduce friction between said nonmetallic wear pads and said track.

* * * * *